US007404657B2

(12) United States Patent
Takada

(10) Patent No.: US 7,404,657 B2
(45) Date of Patent: Jul. 29, 2008

(54) VEHICLE HEADLAMP

(75) Inventor: Kenichi Takada, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/520,566

(22) Filed: Sep. 14, 2006

(65) Prior Publication Data

US 2007/0058387 A1 Mar. 15, 2007

(30) Foreign Application Priority Data

Sep. 15, 2005 (JP) ..... P.2005-268066

(51) Int. Cl.
*F21S 8/10* (2006.01)

(52) U.S. Cl. ..... 362/539; 362/508; 362/517; 362/519; 362/285; 362/297; 362/346; 362/531; 362/549

(58) Field of Classification Search ..... 362/539, 362/507, 508, 517, 519, 285, 297, 346, 531, 362/549, 530, 523, 538
See application file for complete search history.

(56) References Cited

U.S. PATENT DOCUMENTS 1,818,875 A * 8/1931 Wardwell ..... 362/285
5,339,226 A * 8/1994 Ishikawa ..... 362/539
6,271,629 B1 * 8/2001 Pace et al. ..... 315/56
6,386,743 B1 * 5/2002 Futami et al. ..... 362/516
2002/0085388 A1 * 7/2002 Uchida ..... 362/539
2003/0049991 A1 * 3/2003 Kai et al. ..... 445/24

FOREIGN PATENT DOCUMENTS

JP 2002-42516 A 2/2002
JP 2004-327187 A 11/2004

* cited by examiner

*Primary Examiner*—Sharon E Payne
(74) *Attorney, Agent, or Firm*—Sughrue Mion, PLLC

(57) ABSTRACT

A light source is movable between a reference position located on an optical axis on the rear side of a rear side focal point of a projection lens and a forward shift position located on the forward side of the reference position. At a predetermined position of the reflecting surface of a reflector on the lower side of the optical axis, an auxiliary reflecting surface having a vertical section of substantially an elliptical shape is formed which has a first focal point set at the center of the light source at the forward shift position, and a second focal point set at the rear side focal point of the projection lens.

12 Claims, 8 Drawing Sheets

VEHICLE HEADLAMP

This application claims foreign priority from Japanese Patent Application No. 2005-268066, filed Sep. 15, 2005, the content of which is hereby incorporated by reference.

BACKGROUND OF THE INVENTION

1. Field of the Invention

The present invention relates to a projector-type vehicle headlamp and, in particular, relates to a vehicle headlamp which forms a distribution light pattern for a low beam.

2. Description of the Related Art

In general, a projector-type vehicle headlamp is configured such that a projection lens is disposed on an optical axis extending in the longitudinal direction of a vehicle, a light source is disposed on the rear side of the rear side focal point of the projection lens, and the light from the light source is reflected by a reflector toward the optical axis. When a distribution light pattern for a low beam is formed using the projector-type vehicle headlamp, the headlamp is configured such that apart of the light reflected from the reflector is shielded by a shade disposed so that the upper end edge thereof extends near the rear side focal point of the projection lens, thereby forming a predetermined cutoff line at the upper end portion of the low beam distribution light pattern.

JP-A-2002-42516 discloses a projector-type vehicle headlamp having the aforesaid shade. JP-A-2002-42516 discloses a projector-type vehicle headlamp in which a light source is movable between a reference position located near the optical axis thereof and moving positions located in the left, right and lower directions with respect to the reference position, thereby changing the shape and the luminance distribution of a low beam distribution light pattern.

Further, JP-A-2004-327187 discloses a projector-type vehicle headlamp in which a shade is movable, and when the upper end edge thereof is moved slightly downward, the cutoff line of a low beam distribution light pattern is moved slightly upward, thereby improving the visibility at a distant place on the road surface in the forward direction of a vehicle.

By employing the lamp disclosed in JP-A-2004-327187, it is possible to selectively switch between a low beam distribution light pattern suitable for normal driving and a low beam distribution light pattern suitable for high speed driving.

Such selective forming of the distribution light pattern may be obtained by moving the light source instead of moving the shade. However, if one tries to employ the lamp structure disclosed in JP-A-2002-42516, it is difficult to provide selective forming of the distribution light pattern due to the following reasons.

That is, since the vehicle headlamp described in JP-A-2002-42516 is configured to move the light source in a direction perpendicular to the optical axis thereof, the shape and the luminance distribution of the low beam distribution light pattern can be changed, but the degree of light convergence cannot be changed.

Further, the vehicle headlamp described in JP-A-2002-42516 employs the reflecting surface of a reflector which is designed based on an assumption that the light source is located at the reference position, even though the light source moves. Thus, it is not easy to set the low beam distribution light pattern to a desired distribution light pattern with a light source designed to be moved.

Thus, according to such lamp configurations, it is difficult to selectively form the low beam distribution light pattern suitable for the normal driving and the low beam distribution light pattern suitable for the high speed driving.

SUMMARY OF THE INVENTION

According to one aspect of the invention, a vehicle headlamp includes:

a projection lens disposed on an optical axis extending in a longitudinal direction of the vehicle;

a light source disposed on a rear side of a rear side focal point of the projection lens;

a reflector which reflects a light emitted from the light source to a forward direction and toward the optical axis; and a shade disposed such that an upper end edge thereof extends near the rear side focal point of the projection lens, wherein the shade shields apart of the light reflected from the reflector, the light source is movable between a reference position located on the optical axis and a forward shift position located on a forward side of the reference position, and the reflector has an auxiliary reflecting surface located on a lower side of the optical axis, wherein the an auxiliary reflecting surface has a vertical section of an elliptical shape having a first focal point set at a point near the forward shift position and a second focal point set near the rear side focal point of the projection lens.

DESCRIPTION OF THE EXEMPLARY EMBODIMENT

Hereinafter, an exemplary embodiment of the invention will be explained with reference to the drawings, the following exemplary embodiments do not limit the scope of the invention.

Figure 1:
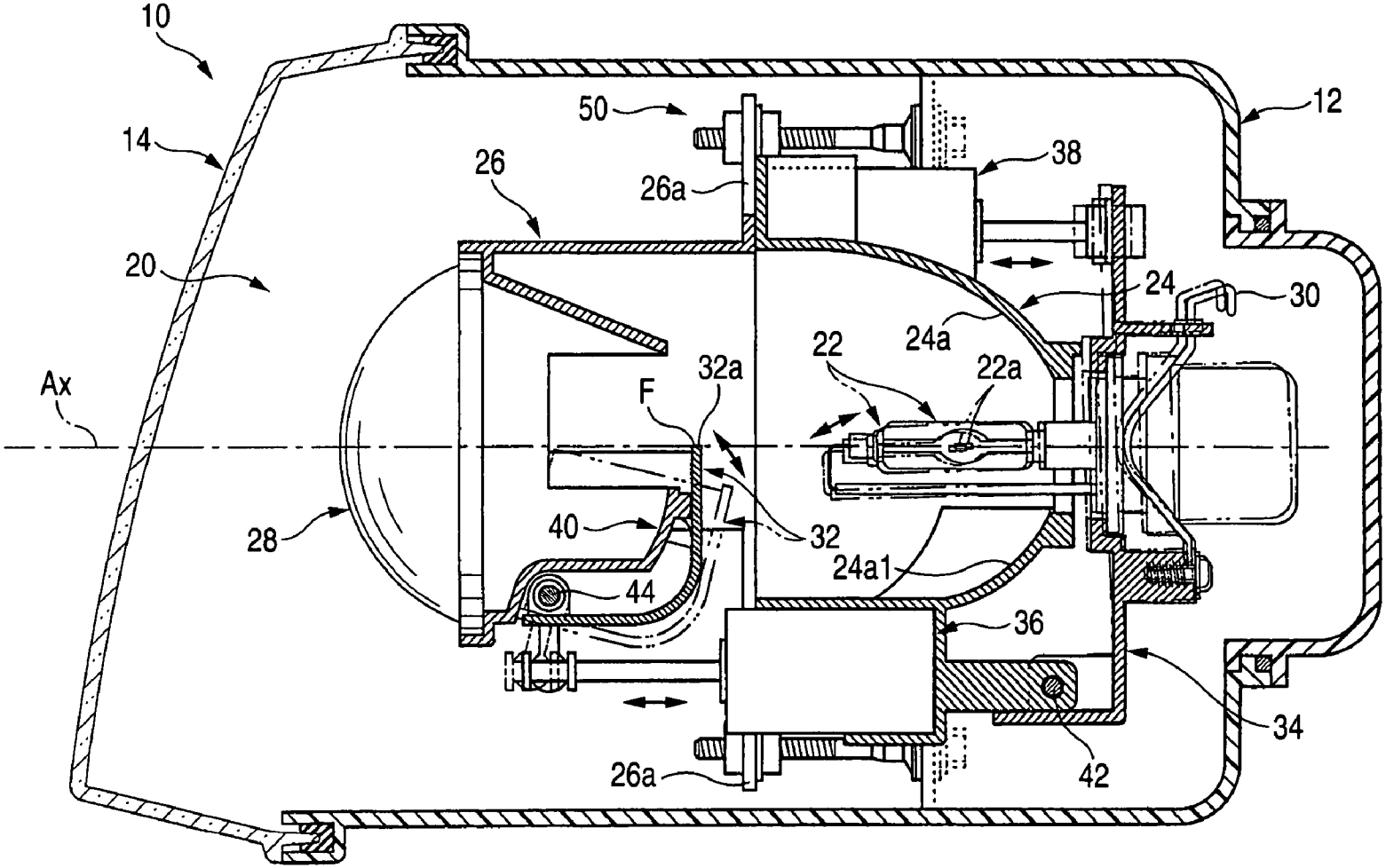
FIG. 1 is a side sectional diagram showing the vehicle headlamp according to an exemplary embodiment of the invention.

FIG. 1 is a side sectional view of a headlamp 10 for a vehicle according to the exemplary embodiment of the invention.

As shown in the figure, a vehicle headlamp 10 has a lamp chamber which is formed by a lamp body 12 and a transparent cover 14 attached to the front end opening portion of the lamp body 12. Within the lamp chamber, a lamp unit 20 having an optical axis Ax extending in the longitudinal direction of a vehicle is housed such that the lamp unit 20 can be inclined in vertical and horizontal directions via an aiming mechanism 50.

In the vehicle headlamp 10, when the aiming adjustment with the aiming mechanism 50 is completed, the optical axis Ax of the lamp unit 20 extends downward by about 0.5° to 0.6° with respect to the longitudinal direction of a vehicle.

Figure 2:
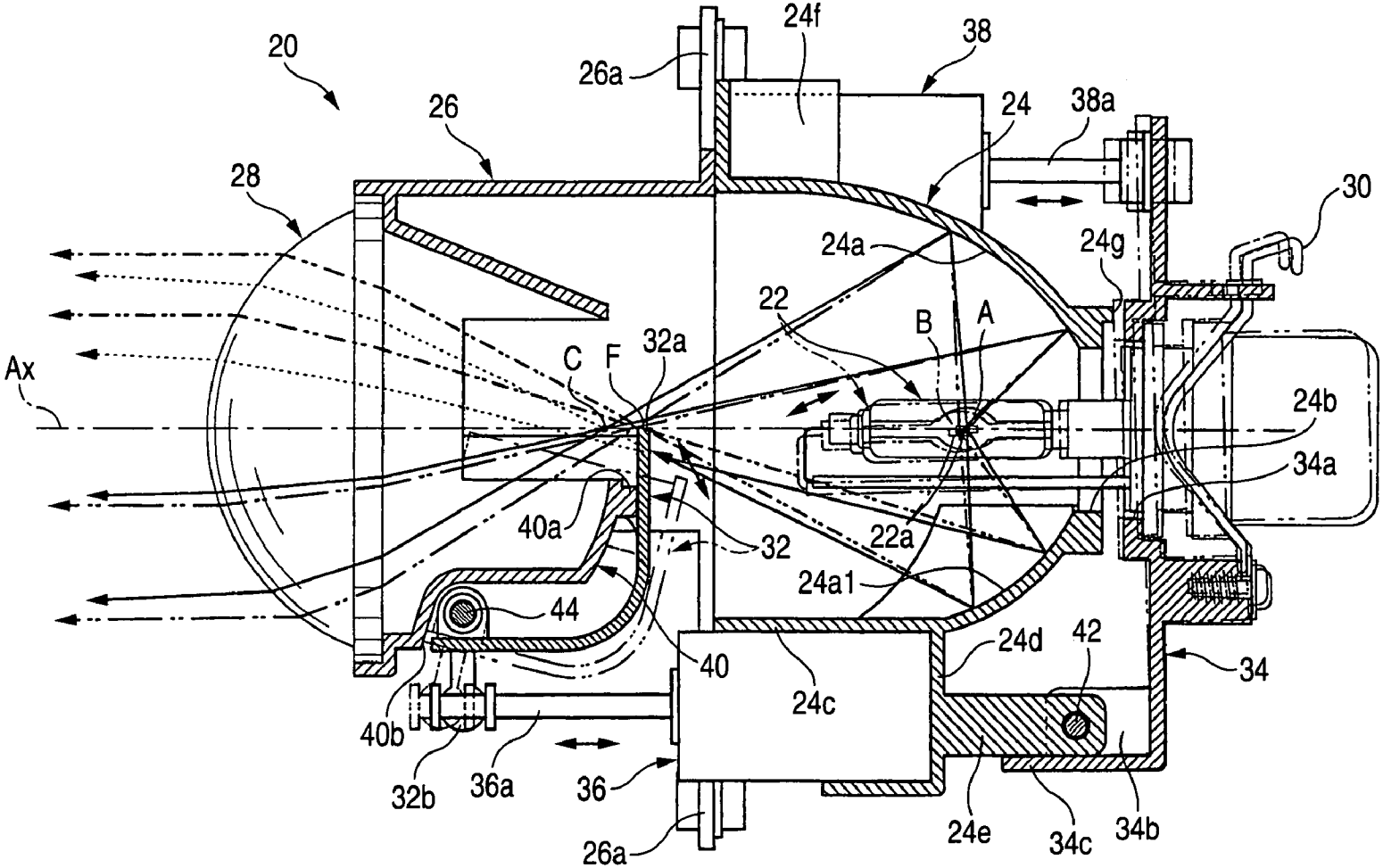
FIG. 2 is a side sectional diagram showing a lamp unit of the vehicle headlamp as a single unit.
Figure 3:
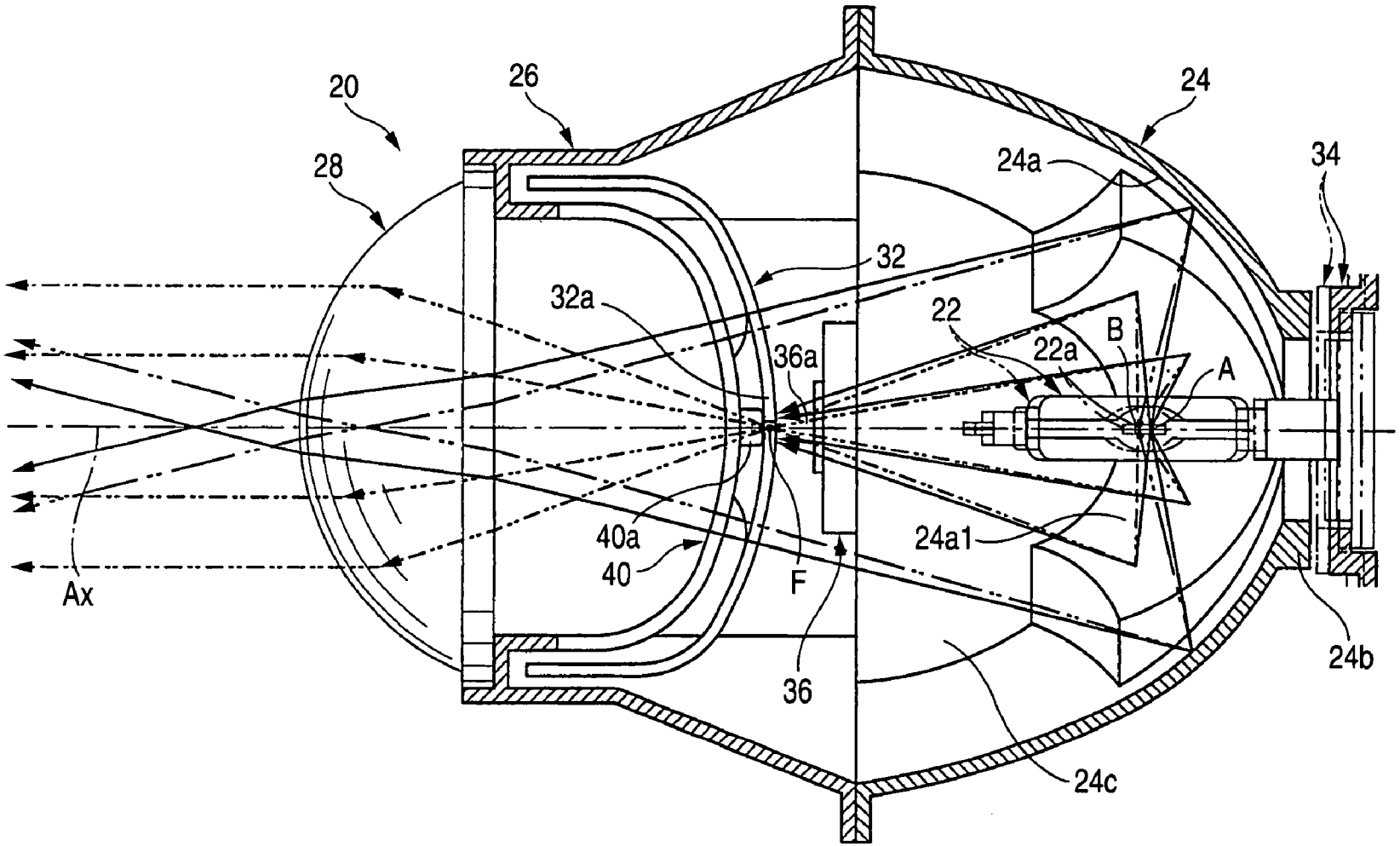
FIG. 3 is a plan sectional diagram showing the lamp unit as a single unit.
Figure 4:
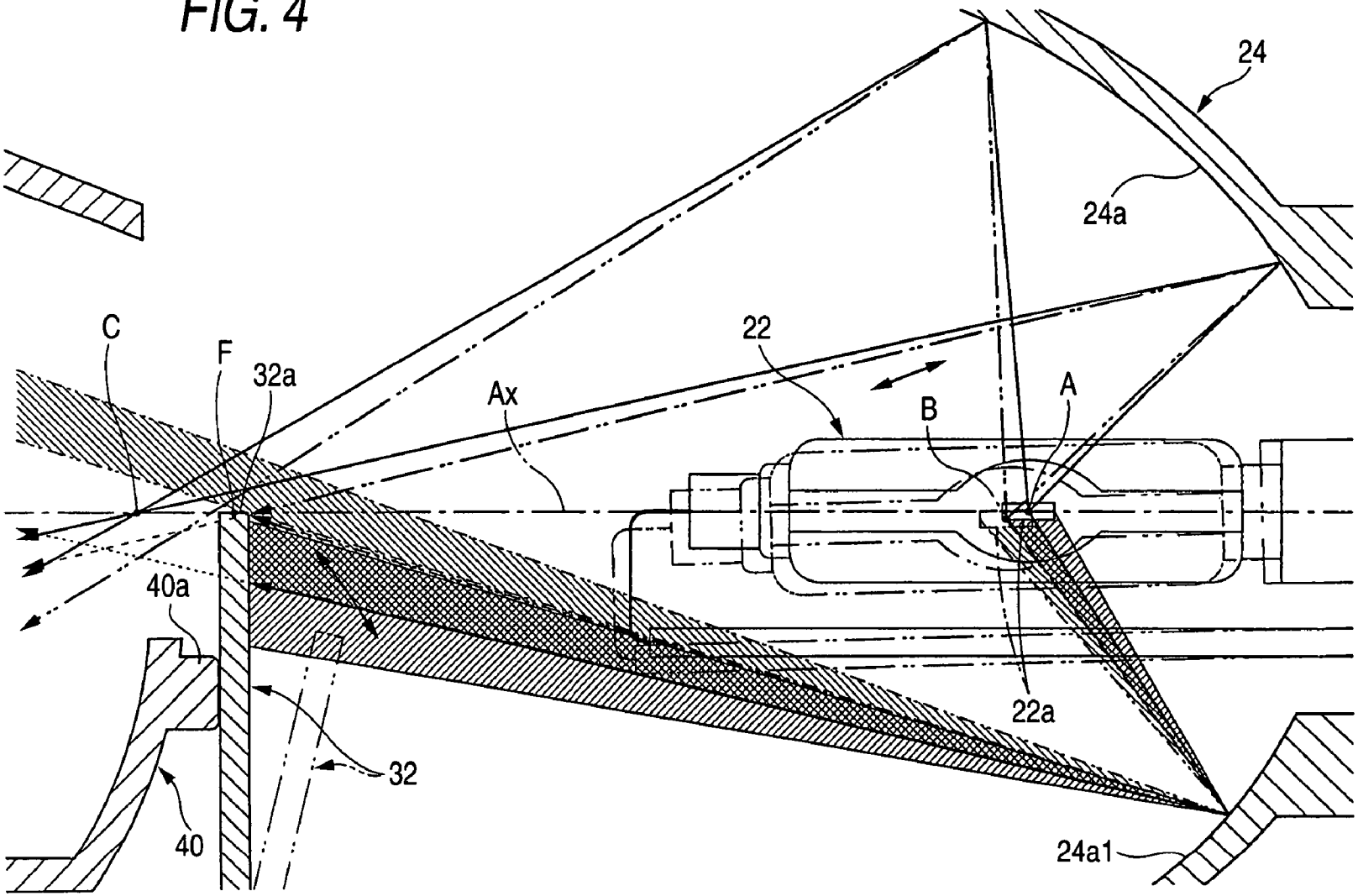
FIG. 4 is a detailed diagram of the lamp unit shown in FIG. 2.

FIG. 2 is a side sectional view of the lamp unit 20 itself, FIG. 3 is a plan sectional view of the lamp unit 20 itself, and FIG. 4 is a detailed diagram of the lamp unit 20 shown in FIG. 2.

As shown in the figures, the lamp unit 20 is a projector-type lamp unit and includes a light source bulb 22, a reflector 24, a holder 26, a projection lens 28, a movable shade 32, a bulb supporting base 34, a shade driving device 36 and a light source driving device 38.

The projection lens 28 is configured as a planar convex a spherical lens having a front side face with a convex surface and a rear side face with a planar surface and is disposed on the optical axis Ax. The projection lens 28 projects an image on a rear side focal point surface including a rear side focal point F thereof in the forward direction as an inverted image.

The light source bulb 22 is a discharge bulb, such as a metal halide lamp, in which a discharge light emitting portion serves as a light source 22*a*. The light source bulb 22 is inserted into and attached to the bulb insertion portion 34*a* of a bulb supporting base 34. The light source bulb 22 is inserted from the rear side into the rear top opening portion 24*b* of the reflector 24 and is fixed by a wire spring 30. The light source 22*a* of the light source bulb 22 is disposed on the rear side of the rear side focal point F of the projection lens 28 and is disposed so as to extend along the optical axis Ax on the optical axis Ax when located at a reference position, which will be described later.

The light source is not limited to a particular kind, and, for example, the discharge light emitting portion of a discharge bulb or the filament of a halogen lamp, etc. may be employed as the light source.

The reflector 24 is configured to reflect a light emitted from the light source 22*a* in the forward direction toward the optical axis Ax.

A reflecting surface 24*a* of the reflector 24 is configured such that the sectional shape thereof including the optical axis Ax is set to an elliptical shape having a first focal point at the center point A of the light source 22*a* on the optical axis Ax. The eccentricity thereof is set to be gradually increase from the vertical section of the reflecting surface 24*a* toward the horizontal section. In this case, the second focal point C of the ellipse constituting the vertical section of the reflecting surface 24*a* including the optical axis Ax is set at a point slightly on the forward side of the rear side focal point F of the projection lens 28. Thus, the reflector 24 reflects the light emitted from the light source 22*a* by the reflecting surface 24*a* such that the light is converged almost at the point C in the vertical sectional plane, whilst the converging position of the light reflected from the reflecting surface 24*a* is fairly shifted in the forward direction in the horizontal sectional plane.

The reflecting surface 24*a* of the reflector 24 is provided with an auxiliary reflecting surface 24*a*1 at a predetermined position located beneath the optical axis Ax. This auxiliary reflecting surface will be explained later.

The holder 26 is formed substantially in a cylindrical shape that extends in the forward direction from the front end opening portion of the reflector 24. The holder 26 fixedly supports the reflector 24 at the rear end portion thereof and also fixedly supports the projection lens 28 at the front end portion thereof. A lower portion of the holder 26 is cut out, and the rear end peripheral portion of the holder 26 is provided with aiming brackets 26*a* which connect the lamp unit 20 with the aiming mechanism 50.

The movable shade 32 is positioned substantially at a lower half portion within the inner space of the holder 26 and is supported so as to be rotatable with respect to the holder 26 via a pivot pin 44 extending in the left and right directions. The movable shade 32 can take both a shielding position shown by a continuous line in FIG. 1 and a shielding release position shown by a two-dot chain line shown also in FIG. 1, the shielding release position being a position in which the movable shade 32 is rotated downward from the shielding position by a predetermined angle.

An upper end edge 32*a* of the movable shade 32 is formed to have different heights at the left and right sides thereof and extends in the horizontal direction substantially in an arc shape. The upper end edge 32*a* is disposed so as to extend along the rear side focal point plane including the rear side focal point F of the projection lens 28 when the movable shade 32 is located at the shielding position, whilst the upper end edge 32*a* is disposed in the obliquely downward direction on the rear side of the shielding position when the movable shade 32 is located at the shielding release position.

In the forward direction of the movable shade 32, a fixed shade 40 for preventing stray light that is reflected by the reflector 24 from entering into the projection lens 28 is integrally formed with the holder 26. The fixed shade 40 is provided with a positioning abutment portion 40*a* which abuts against the movable shade 32, thereby positioning the movable shade at the shielding position when the movable shade 32 is shifted to the shielding position, and is further provided with another positioning abutment portion 40*b* which abuts against the movable shade 32, thereby positioning the movable shade at the shielding release position when the movable shade 32 is shifted to the shielding release position.

The shade driving device 36 is configured by a solenoid having a plunger 36*a* extending in the forward direction and is fixed to a device attachment portion 24*d* formed at the lower surface of the bottom face wall 24*c* of the reflector 24. The plunger 36*a* of the shade driving device 36 engages at the tip end portion thereof with a stay 32*b* which is formed so as to protrude downward from the movable shade 32, thereby transmitting the reciprocal movement in the longitudinal direction of the plunger 36*a* as the rotational movement of the movable shade 32. The shade driving device 36 is driven when a beam change over switch (not-shown) is operated to move the plunger 36*a* in the longitudinal direction, thereby moving the movable shade 32 between the shielding position and the shielding release position.

The shade need not be a movable shade and may instead be a fixed type shade which is fixed in a state that the upper end edge thereof is disposed so as to extend near the rear side focal point of the projection lens.

The bulb supporting base 34 is located near the rear side of the rear top opening portion 24*b* of the reflector 24 and is supported rotatably at its lower end portion by the reflector 24. That is, the bulb supporting base 34 is coupled, at a bracket 34*b* formed at the lower end portion thereof via a pivot pin 42 extending in the left and right directions, with the tip end portion of a bracket 24*e* extending in the backward direction from the device attachment portion 24*d* of the reflector 24, whereby the bulb supporting base is rotatable around the pivot pin 42. The pivot pin 42 is disposed at a position backward by almost 10° to 30° with respect to the vertical downward direction of the light source 22*a*.

The light source driving device 38 is configured by a solenoid having a plunger 38*a* extending in the backward direction, and is fixed to a device attachment portion 24*f* formed at the upper surface of the reflector 24. The plunger 38*a* of the light source driving device 38 engages at the tip end portion thereof with the upper end portion of the bulb supporting base 34, thereby to transmit the reciprocal movement of the plunger 38*a* in the longitudinal direction to the rotational movement of the bulb supporting base 34. The light source driving device 38 is driven by a driving signal from a driving control means (not-shown) that moves the plunger 38*a* in the longitudinal direction, thereby moving the light source 22*a* between the reference position where the center of the light source is located at the point A and a forward shift position where the center of the light source is located at a point B, which is slightly beneath and in the forward direction of the point A. More specifically, the point B is set at a position which is in the forward direction by about 2 mm and beneath by about 0.5 mm with respect to the point A.

The forward shift position is not limited to a particular position as long as it is located on the forward side of the reference position. However, it is preferable that the forward shift position is set at a position on the forward side by 1 to 3 mm with respect to the reference position, and is more preferable that the forward shift position is set at a position on the forward side by 1.5 to 2.5 mm with respect to the reference position.

The bulb supporting base 34 is provided at the lower end portion thereof with a positioning abutment portion 34*c* which abuts against the bracket 24*e* of the reflector 24 thereby to position the light source 22*a* at the reference position when the light source 22*a* is shifted to the reference position. The reflector 24 is provided at the upper portion of the rear top opening portion 24*b* with a positioning abutment portion 24*g* which abuts against the upper end portion of the bulb insertion portion 34*a* of the bulb supporting base 34, thereby positioning the light source 22*a* at the forward shift position when the light source 22*a* is shifted to the forward shift position.

When the light source 22*a* is located at the reference position, since the center of the light source is located at the point A which is the first focal point of the ellipse, the light emitted from the center of the light source 22*a* and reflected by the reflecting surface 24*a* of the reflector 24 crosses the optical axis Ax at a point C which is the second focal point of the ellipse with respect to the vertical direction, as shown by continuous lines in FIGS. 2 and 4. On the other hand, when the light source 22*a* is located at the forward shift position, since the center of the light source is located at the point B which is slightly beneath and in the forward direction of the point A, the light emitted from the center of the light source 22*a* and reflected by the reflecting surface 24*a* of the reflector 24 crosses with the optical axis Ax on the rear side of the point C with respect to the vertical direction, as shown by two-dot chain lines in FIGS. 2 and 4. In this case, since the point C is located on the forward side of the rear side focal point F of the projection lens 28, the light converging degree of the light reflected from the reflecting surface. 24*a* in the rear side focal point plane of the projection lens 28 is higher when the light source 22*a* is located at the forward shift position than when the light source 22*a* is located at the reference position.

The auxiliary reflecting surface 24*a*1 of the reflector 24 is formed such that a substantially horizontal belt-shaped region located at the lower side of the optical axis Ax of the reflecting surface 24*a* of the reflector 24 is protruded in the forward direction. More specifically, the auxiliary reflecting surface 24*a*1 is disposed such that the upper end edge thereof is located about 10 mm lower than the optical axis Ax, the lower end edge thereof is located at the upper surface of the bottom face wall 24*c* of the reflector 24, and the front end edge thereof is located slightly on the forward side of the light source 22*a*.

The auxiliary reflecting surface 24*a*1 has a spheroidal surface having a first focal point set at the point B and a second focal point set at the rear side focal point F of the projection lens 28. Thus, when the light source 22*a* is shifted to the forward shift position, the auxiliary reflecting surface 24*a*1 reflects the light emitted from the light source 22*a* and converges the light on the rear side focal point F of the projection lens 28, as shown in FIGS. 2 and 3. In this case, as shown in FIG. 4, when the movable shade 32 is located at the shielding position, almost half of the light emitted from the light source 22*a* and reflected by the auxiliary reflecting surface 24*a*1 is incident on the movable shade 32 and therefore shielded by the movable shade 32. On the other hand, when the movable shade 32 is located at the shielding release position, the entire light reflected by the auxiliary reflecting surface 24*a*1 is directed to the projection lens 28 without being incident on the movable shade 32.

When the light source 22*a* is located at the reference position, since the auxiliary reflecting surface 24*a*1 is formed by the spheroid, the light emitted from the light source 22*a* and reflected by the auxiliary reflecting surface 24*a*1 substantially converges on the lower side of the rear side focal point F of the projection lens 28 as shown in FIGS. 2 and 3. Then, as shown in FIG. 4, when the movable shade 32 is located at the shielding position, almost the entire light reflected by the auxiliary reflecting surface 24*a*1 is incident on the movable shade 32 and therefore shielded by the movable shade 32. On the other hand, when the movable shade 32 is located at the shielding release position, almost the entire light reflected by the auxiliary reflecting surface 24*a*1 is directed to the projection lens 28 without being incident on the movable shade 32.

The auxiliary reflecting surface is formed at a position on the reflecting surface of the reflector located on the lower side of the optical axis. However, the specific forming position, size, outer shape thereof is not limited. Further, the horizontal sectional shape of the auxiliary reflecting surface is not limited to a particular shape as long as the vertical sectional shape thereof is set to substantially an elliptical shape which has the first focal point set near the forward shift position and also has the second focal point set near the rear side focal point of the projection lens.

Figure 5A:
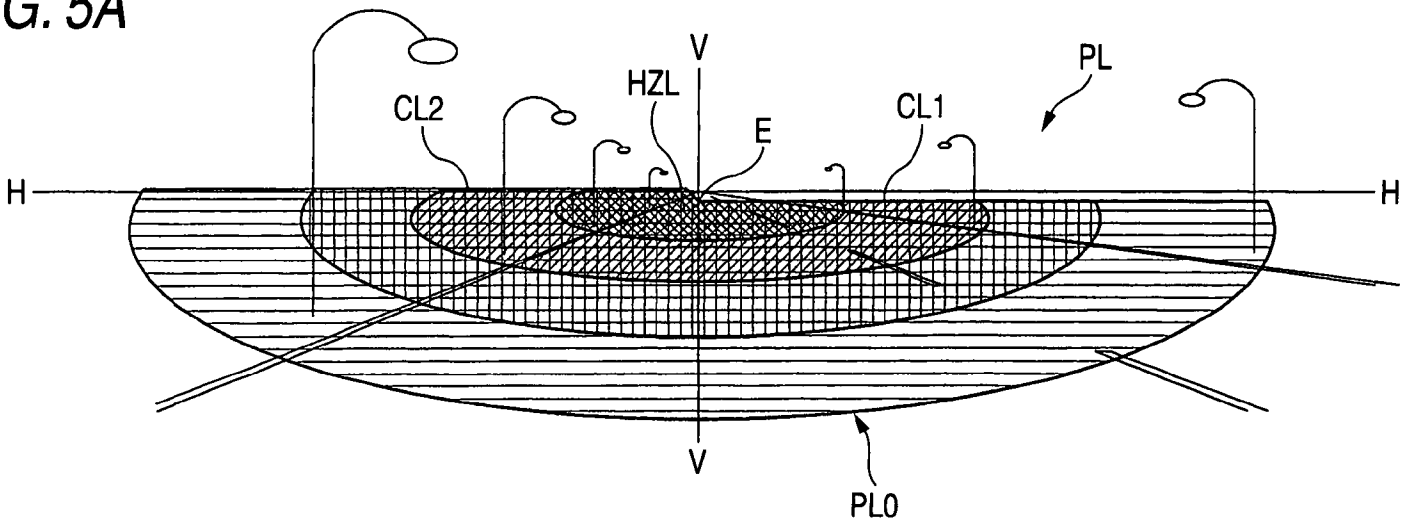
FIG. 5A is a perspective diagram showing low beam distribution light patterns formed, by light irradiated in the forward direction from the vehicle headlamp, on a phantom vertical screen disposed at a position 25 m forward from the lamp when the light source is located at the reference position.
Figure 5B:
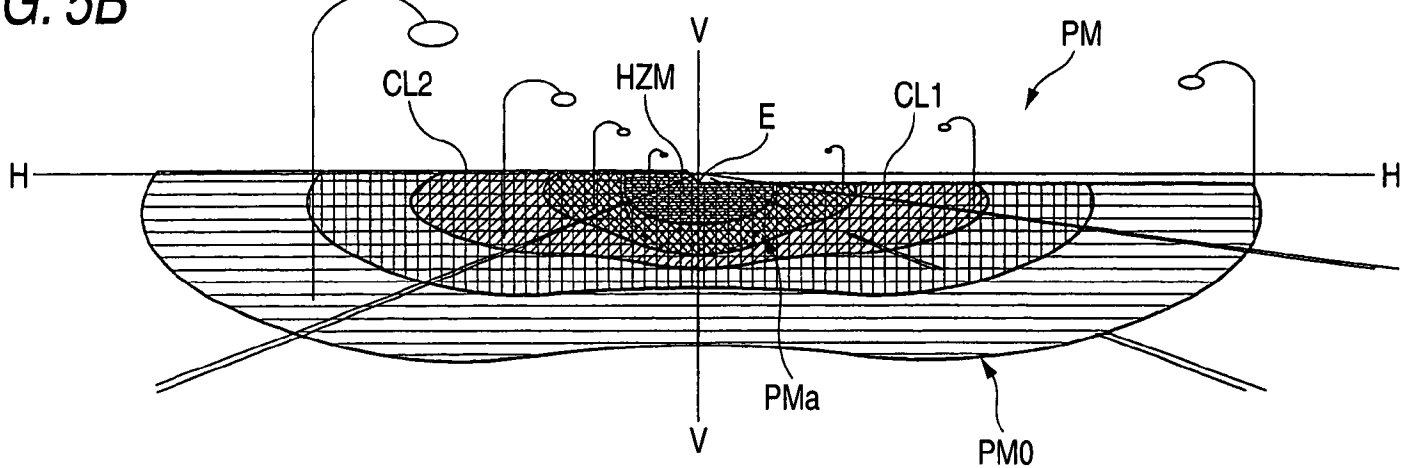
FIG. 5B is a perspective diagram showing low beam distribution light patterns formed, by light irradiated in the forward direction from the vehicle headlamp, on a phantom vertical screen disposed at a position 25 m forward from the lamp when the light source is shifted to the forward shift position.

FIG. 5A is a perspective diagram showing a low beam distribution light pattern PL, and FIG. 5B is a perspective diagram showing a low beam distribution light pattern PM, each low beam distribution light pattern being formed on a phantom vertical screen disposed at a position 25 m forward from the lamp by the light irradiated in the forward direction from the vehicle headlamp 10.

The low beam distribution light pattern PL shown in FIG. 5A is a distribution light pattern for normal driving which is formed when the light source 22*a* is located at the reference position and the movable shade 32 is located at the shielding position.

The low beam distribution light pattern PL is a low beam distribution light pattern for the left distribution light and has cutoff lines CL1, CL2 having different heights at the left and right sides thereof at the upper end edge of the pattern. The cutoff lines CL1,CL2 extend respectively in the horizontal direction with the different left and right side heights having a boarder line on V-V line which crosses with a vanishing point H-V in the front direction of the lamp and extends in the vertical direction. The opposite lane side portion of the cutoff lines on the right side with respect to the V-V line is formed as the lower cutoff line CL1. The own lane side portion on the left side with respect to the V-V line is formed as the upper cutoff line CL2 which rises in a step manner via a tilted portion from the lower cutoff line CL1. In the low beam distribution light pattern PL, an elbow point E, which is a cross point between the lower cutoff line CL1 and the V-V line, is set to a position downward by about 0.5° to 0.6° with respect to the point H-V. A hot zone HZL, which is a high luminance area, is formed so as to surround the elbow point E.

The low beam distribution light pattern PL is formed such that an image of the light source 22*a* formed on the rear side focal plane of the projection lens 28 by the light emitted from the light source 22*a* and reflected by the reflecting surface 24*a* of the reflector 24 is projected by the projection lens 28 on the phantom vertical screen as an inverted projection image. The cutoff lines CL1, CL2 are formed as the inverted projection image of the upper end edge 32*a* of the movable shade 32.

The low beam distribution light pattern PM shown in FIG. 5B is a distribution light pattern for high speed driving which is formed when the light source 22*a* is located at the forward shift position and the movable shade 32 is located at the shielding position.

The low beam distribution light pattern PM is the same as the low beam distribution light pattern PL in terms of the cutoff lines CL1, CL2, but slightly smaller than the low beam distribution light pattern PL in terms of the entire diffusion angle, and the hot zone HZL is brighter than that of the low beam distribution light pattern PL. This is because the light converging degree of the light reflected from the reflecting surface 24*a* on the rear side focal point plane of the projection lens 28 is higher in the case where the light source 22*a* is located at the forward shift position than in the case where the light source is located at the reference position, and the light reflected from the auxiliary reflecting surface 24*a*1 is added to the light reflected from the reflecting surface 24*a* of the reflector 24.

A detailed description of the light distribution patterns above will be described below.

Figure 6A:
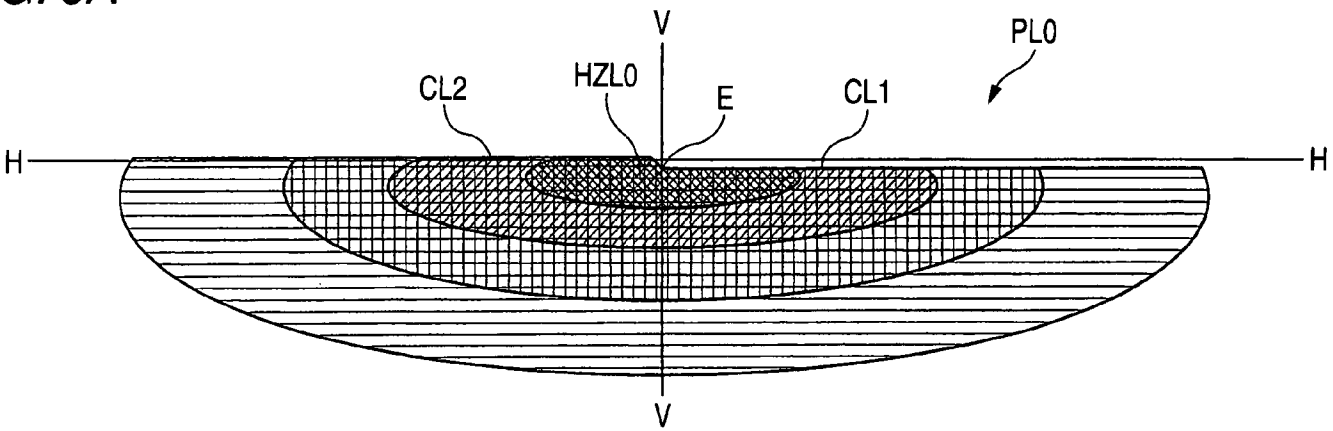
FIG. 6A is a diagram showing a basic distribution light pattern formed by the light reflected by a portion of the reflecting surface of the reflector excluding the auxiliary reflecting surface in the lamp unit, when the light source is located at the reference position.
Figure 6B:
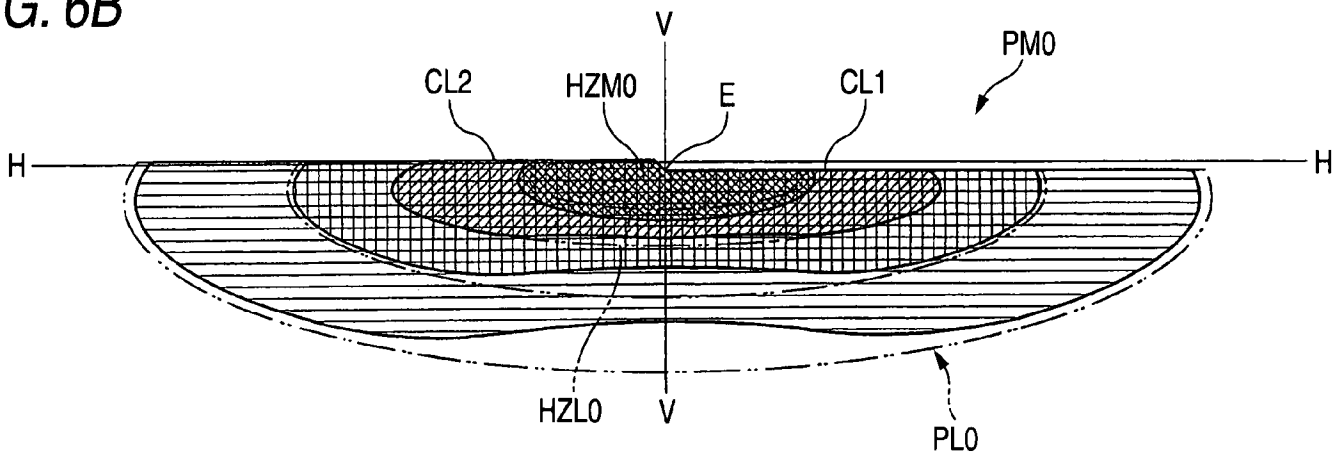
FIG. 6B is a diagram showing a basic distribution light pattern formed by the light reflected by a portion of the reflecting surface of the reflector excluding the auxiliary reflecting surface in the lamp unit, when the light source is shifted to the forward shift position.
Figure 7A:
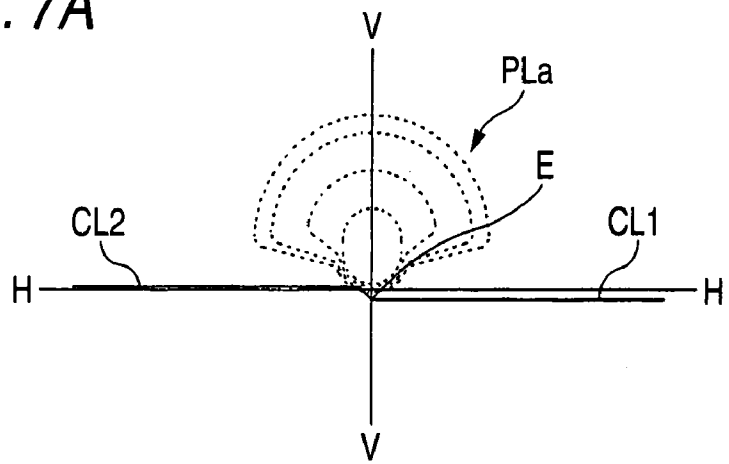
FIG. 7A is a diagram showing an auxiliary distribution light pattern formed by the light reflected from the auxiliary reflecting surface, when the light source is located at the reference position.

The low beam distribution light pattern PL is formed as a composite distribution light pattern of a basic distribution light pattern PL0 shown in FIG. 6A and an auxiliary distribution light pattern PLa shown in FIG. 7A. On the other hand, the low beam distribution light pattern PM is formed as a composite distribution light pattern of a basic distribution light pattern PM0 shown in FIG. 6B and an auxiliary distribution light pattern PMa shown in FIG. 7B.

The basic distribution light pattern PL0 shown in FIG. 6A is a distribution light pattern formed by the light reflected from the portion of the reflecting surface 24*a* of the reflector 24 excluding the portion where the auxiliary reflecting surface 24*a*1 is formed (hereinafter referred to "a general reflecting portion"). The auxiliary distribution light pattern PLa shown in FIG. 7A is a distribution light pattern formed by the light reflected from the auxiliary reflecting surface 24*a*1 of the reflector 24.

As shown in FIG. 7A, the auxiliary distribution light pattern PLa is located near the elbow point E on the upper side thereof and not formed on the lower side of the cutoff lines CL1, CL2. This is because the light reflected from the auxiliary reflecting surface 24*a*1 is shielded by the movable shade 32 when the light source 22*a* is located at the reference position. Thus, the low beam distribution light pattern PL shown in FIG. 5A is the same distribution light pattern as the basic distribution light pattern PL0 shown in FIG. 6A.

When the movable shade 32 is shifted to the shield release position, the auxiliary distribution light pattern PLa is formed near the cutoff lines CL1, CL2 on the upper side thereof as a part of the high beam distribution light pattern. In this case, since the auxiliary distribution light pattern PLa is a distribution light pattern of substantially a fan shape in which the light converging degree is high near the upper portion of the point H-V, the auxiliary distribution light pattern enhances the center luminance of the high beam distribution light pattern.

Figure 7B:
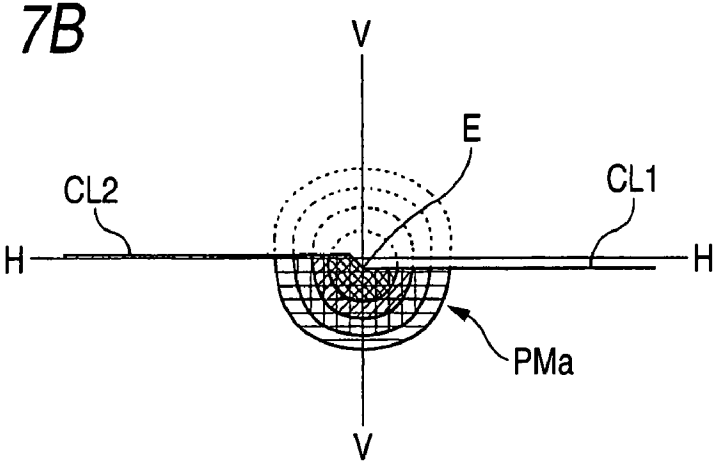
FIG. 7B is a diagram showing an auxiliary distribution light pattern formed by the light reflected from the auxiliary reflecting surface, when the light source is shifted to the forward shift position.

On the other hand, as shown in FIG. 7B, the auxiliary distribution light pattern PM a is positioned near the elbow point E so as to cross over the cutoff lines CL1, CL2, and almost half of the lower portion thereof is formed on the lower side of the cutoff lines CL1, CL2. This is because the light reflected from the auxiliary reflecting surface 24*a*1 is converged on the rear side focal point F of the projection lens 28 when the light source 22*a* is located at the forward shift position. The low beam distribution light pattern PM shown in FIG. 5B is a distribution light pattern in which the auxiliary distribution light pattern PMa is added to the low beam distribution light pattern PM0 shown in FIG. 6B near the elbow point E thereof. When the light source 22*a* is located at the forward shift position, the light converging degree of the light reflected from the general reflecting portion of the reflecting surface 24*a* is high on the rear side focal point plane of the projection lens 28. Thus, as shown in FIG. 6B, the hot zone HZM0 of the basic distribution light pattern PM0 is brighter than the hot zone HZL0 of the basic distribution light pattern PL0. Further, the basic distribution light pattern PM0 is bent in the upward direction near the V-V line at the lower end edge thereof. This is because, the light reflected from the upper and lower portions of the reflecting surface 24*a* with respect to the optical axis Ax change a shape of the distribution light pattern due to the forward shift of the light source 22*a* more than the light reflected from the left and right portions of the reflecting surface 24*a* with respect to the optical axis Ax.

The auxiliary distribution light pattern PMa is also formed near the cutoff lines CL1, CL2 on the upper side thereof as a part of the high beam distribution light pattern when the movable shade 32 is shifted to the shielding release position. In this case, since the auxiliary distribution light pattern PMa is a distribution light pattern of substantially a circular shape in which the light converging degree is high near the elbow point E, the auxiliary distribution light pattern enhances the center luminance of the high beam distribution light pattern.

Figure 7C:
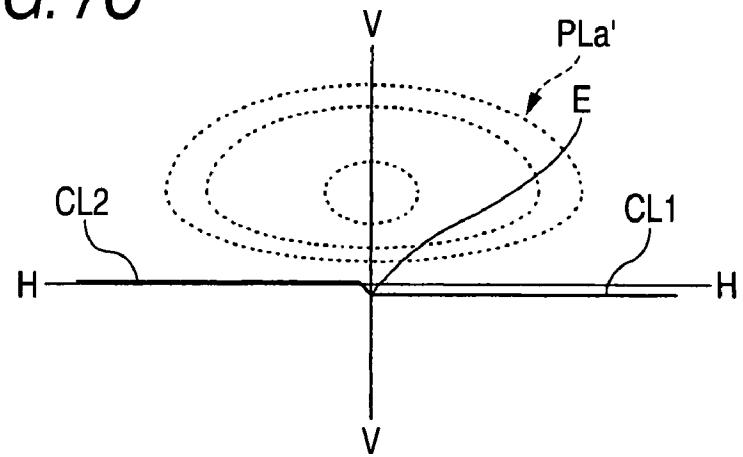
FIG. 7C is a diagram showing a comparative example of an auxiliary distribution light pattern with respect to the auxiliary distribution light pattern shown in FIG. 7A.
Figure 7D:
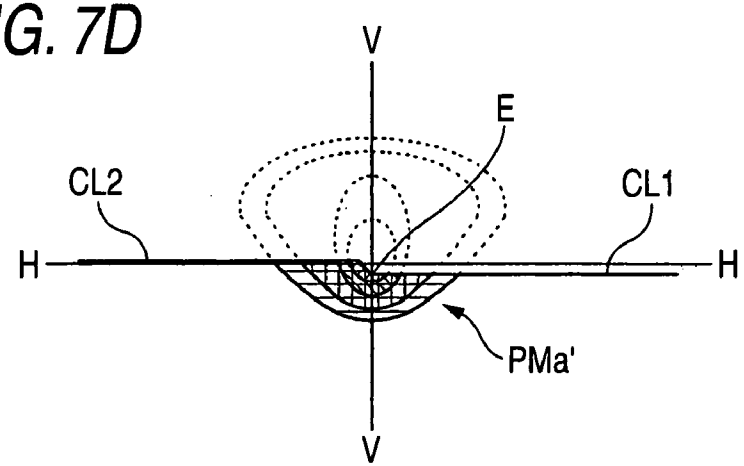
FIG. 7D is a diagram showing a comparative example of an auxiliary distribution light pattern with respect to the auxiliary distribution light pattern shown in FIG. 7B.

FIGS. 7C and 7D are diagrams showing auxiliary distribution light patterns PLa', PMa' formed instead of the auxiliary distribution light patterns PLa, PMa if the auxiliary reflecting surface 24*a*1 were not formed on the reflecting surface 24*a*, and a part where the auxiliary reflecting surface 24*a*1 is formed were configured by a reflecting surface that is same as the general reflecting portion.

As shown in FIG. 7C, the auxiliary distribution light pattern PLa' is a distribution light pattern of substantially a wide elliptical shape which has a lower light converging degree than the auxiliary distribution light pattern PLa. Since the auxiliary distribution light pattern PLa' is formed above the cutoff lines CL1, CL2, the auxiliary distribution light pattern does not influence on the low beam distribution light pattern PL, and further, does not enhance the center luminance of the high beam distribution light pattern.

On the other hand, as shown in FIG. 7D, the auxiliary distribution light pattern PMa' is a distribution light pattern of substantially an inverted triangle shape in which only the lower tip portion is formed on the lower side of the cutoff lines CL1, CL2. Thus, the auxiliary distribution light pattern PMa' does not enhance the center luminance of the low beam distribution light pattern PM much. Further, although the auxiliary distribution light pattern PMa' enhances the center luminance of the high beam distribution light pattern to some extent, the degree of the contribution thereof is lower than the auxiliary distribution light pattern PMa.

FIGS. 8A to 8D are diagrams showing the images of the light source 22*a* formed on the phantom vertical screen corresponding to FIGS. 7A to 7D.

Figure 8A:
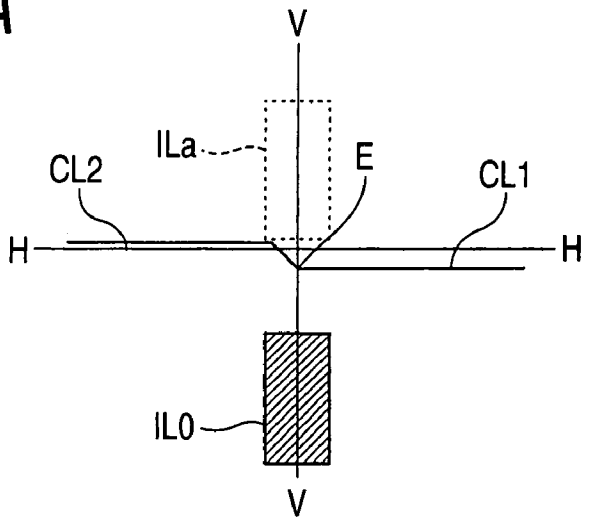
FIG. 8A is a diagram showing an image of the light source formed on the phantom vertical screen corresponding to FIG. 7A.

As shown in FIG. 8A, when the light source 22*a* is located at the reference position, a light source image IL0 formed by the light reflected from a point of the general reflecting portion of the reflecting surface 24*a* located right above the optical axis Ax is formed such that an upper end edge of the image is slightly away from the elbow point E on the lower side. On the other hand, a light source image ILa formed by the light reflected from a point of the auxiliary reflecting surface 24*a*1 located right beneath the optical axis Ax is formed such that a lower end edge of the image is near the elbow point E on the upper side.

Figure 8B:
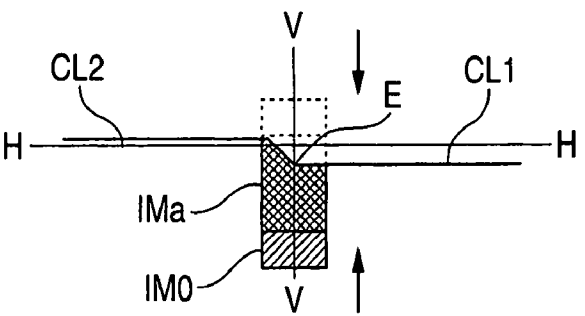
FIG. 8B is a diagram showing an image of the light source formed on the phantom vertical screen corresponding to FIG. 7B.

As shown in FIG. 8B, when the light source 22*a* is shifted to the forward shift position from the state shown in FIG. 8A, the light source image IM0 formed by the light reflected from the point of the general reflecting portion of the reflecting surface 24*a* located right above the optical axis Ax is formed such that the upper end edge of the image shifts to a position near the elbow point E on the upper side. On the other hand, the light source image IMa formed by the light reflected from the point of the auxiliary reflecting surface 24*a*1 located right beneath the optical axis Ax is formed such that the lower end edge of the image shifts to a position slightly away from the elbow point E on the lower side thereof. Thus, most of these two light source images IM0, IMa overlaps in a region near the elbow point E on the lower side thereof.

Figure 8C:
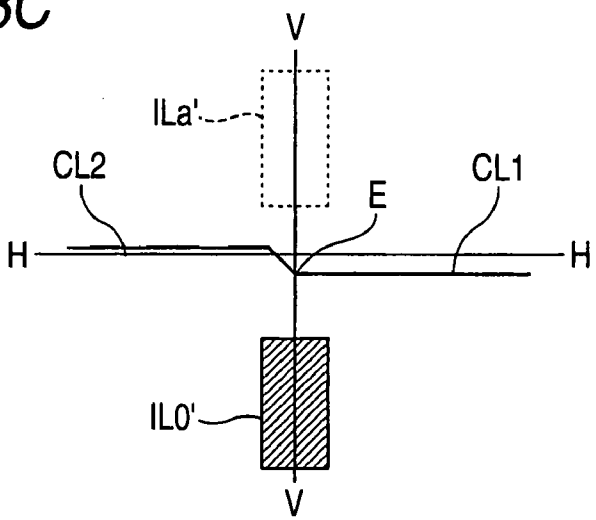
FIG. 8C is a diagram showing an image of the light source formed on the phantom vertical screen corresponding to FIG. 7C.

If the auxiliary reflecting surface 24*a*1 is not formed on the reflecting surface 24, and apart where the auxiliary reflecting surface 24*a*1 is formed is configured by a reflecting surface similar to that of the general reflecting portion, the light source image IL0' formed by the light reflected from the point of the reflecting surface 24*a* located right above the optical axis Ax is formed such that an upper end edge of the image is positioned slightly away from the elbow point E on the lower side, like the light source image IL0, when the light source 22*a* is located at the reference position as shown in FIG. 8C. However, a light source image ILa' formed by the light reflected from the point of the reflecting surface 24*a* located right beneath the optical axis Ax is formed such that the lower end edge of the image is positioned slightly away from the elbow point E on the upper side.

Figure 8D:
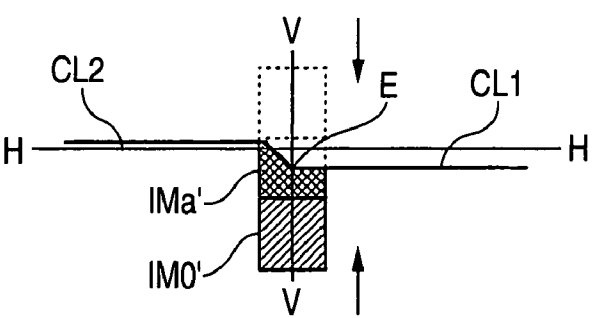
FIG. 8D is a diagram showing an image of the light source formed on the phantom vertical screen corresponding to FIG. 7D.

As shown in FIG. 8D, when the light source 22*a* is shifted to the forward shift position from the state shown in FIG. 8C, the light source image IM0' formed by the light reflected from the point of the reflecting surface 24*a* located right above the optical axis Ax is formed such that the upper end edge of the image is shifted to apposition near the elbow point E on the upper side, like the case of the light source image IM0. On the other hand, the light source image IMa' formed by the light from reflected the point of the reflecting surface 24*a* located right beneath the optical axis Ax is formed such that the lower end edge of the image is shifted to a position near the elbow point E on the lower side. Thus, only small portions of these two light source images IM0', IMa' overlap in a region near the elbow point E on the lower side.

According to the exemplary embodiment, since the auxiliary reflecting surface 24*a*1 is formed on the reflecting surface 24*a*, the center luminance of the low beam distribution light pattern PM shown in FIG. 5B is made higher by a degree corresponding to a difference between the size of the overlapping portion of the two light source images IM0, IMa shown in FIG. 8B and the size of the overlapping portion of the two light source images IM0', IMa' shown in FIG. 8D.

As explained in detail above, the vehicle headlamp 10 according to the exemplary embodiment is the projector-type vehicle headlamp having the movable shade 32, and is capable of forming the low beam distribution light-pattern. The light source 22*a* is movable between the reference position located on the shaft Ax and the forward shift position located on the forward side than the reference position. Further, at the predetermined position of the reflecting surface 24*a* of the reflector 24 located on the lower side of the optical axis Ax, the auxiliary reflecting surface 24*a*1 is formed by the spheroid having the first focal point set at the point B, which is the center of the light source at the forward shift position, and the second focal point set at the rear side focal point F of the projection lens 28. Thus, the following effects can be obtained.

That is, when the light source 22*a* is located at the reference position, a part of the light reflected from the reflector 24 is shielded by the movable shade 32 which is disposed such that the upper end edge 32*a* extends including the rear side focal point F of the projection lens 28, whereby the low beam distribution light pattern PL is formed which has the cutoff lines CL1, CL2 at the upper end portion thereof as the inverted image of the upper end edge 32*a*.

On the other hand, when the light source 22*a* is shifted to the forward shift position, the light converging degree of the light reflected from the reflector 24 onto the rear side focal point plane of the projection lens 28 is made higher. Therefore, the low beam distribution light pattern PM can be formed which is smaller in entire diffusion angle, higher in center luminance, and excellent in visibility at a distant place.

Further, since the low beam distribution light pattern PM is bent in the upward direction near the V-V line at the lower end edge thereof, the brightness at a short distance area on the road surface in the forward direction of a vehicle is reduced by a degree corresponding to the bent degree of the pattern, and thus the visibility at a distant place can be further improved.

Therefore, the low beam distribution light pattern can be set to be suitable for the normal driving when the light source 22*a* is located at the reference position, whilst the low beam distribution light pattern can be set to be suitable for the high-speed driving when the light source 22*a* is shifted to the forward shift position.

Further, in this case, since the auxiliary reflecting surface 24*a*1 formed by the spheroid is has the first focal point set at the point B which is the center of the light source at the forward shift position, and the second focal point set at the rear side focal point F of the projection lens 28, the light reflected from the auxiliary reflecting surface 24*a*1 can be converged on the rear side focal point F of the projection lens 28. Thus, the center luminance of the low beam distribution light pattern PM can be increased to the maximum degree thereby to further improve the visibility in a distant place.

In such manner, in the vehicle headlamp 10 according to the exemplary embodiment, either one of the low beam distribution light pattern PL suitable for the normal driving and the low beam distribution light pattern PM suitable for the high-speed driving can be selectively formed by moving the light source 22*a*.

In the vehicle headlamp 10 according to the exemplary embodiment, the forward shift position is set at the positions lightly lower than the reference position. Thus, as compared with a case where the forward shift position is set at the same height as the reference position, the position at the rear side focal point F of the projection lens 28, where the light reflected from the reflecting surface 24*a* of the reflector 24 converges, can be shifted slightly on the upper side when the light source 22*a* is shifted to the forward shift position. Thus, an amount of light shielded by the movable shade 32 can be reduced thereby to effectively use the light flux of the light source. As a result, the center luminance of the low beam distribution light pattern PM formed when the light source 22*a* is shifted to the forward shift position can be further increased.

Further, in the vehicle headlamp 10 according to the exemplary embodiment, the auxiliary reflecting surface 24*a*1 is configured such that, when the light source 22*a* is located at the reference position, almost the entire amount of the light reflected from the auxiliary reflecting surface 24*a*1 enters into the movable shade 32. Thus, due to the light reflected from the auxiliary reflecting surface 24*a*1, the low beam distribution light pattern PL formed when the light source 22*a* is located at the reference position can be prevented from being brighter than what is required as the low beam distribution light pattern for the normal driving.

Alternatively, it is possible to arrange the vehicle headlamp such that a part of the light reflected from the auxiliary reflecting surface 24*a*1 enters into the movable shade 32 when the light source 22*a* is located at the reference position. By employing such configuration, even if a halogen lamp etc., which cannot provide a sufficient light flux as the light source, is used as the light source bulb 22 in place of the discharge lamp of the exemplary embodiment, the center luminance of the low beam distribution light pattern for the normal driving can be increased to some extent.

Furthermore, in the vehicle headlamp 10 according to the exemplary embodiment, since the movable shade 32 which is configured to take either one of the shielding position and the shielding release position is employed, the beam change between the low beam and the high beam can be performed by shifting the movable shade 32. Instead of using the movable shade 32 of the exemplary embodiment, the vehicle headlamp may be configured such that a shade fixed to the shielding position is provided so that the vehicle headlamp 10 is used only as a lamp for the low beam.

Furthermore, in the vehicle headlamp 10 according to the exemplary embodiment, since the auxiliary reflecting surface 24*a*1 is formed by a spheroid, when the light source 22*a* is shifted to the forward shift position, the light converging degree of the light reflected from the auxiliary reflecting surface 24*a*1 on the area near the rear side focal point F of the projection lens 28 can be made maximum. Alternatively, the auxiliary reflecting surface 24*a*1 may be formed such that the vertical sectional shape thereof is set to be an elliptical shape which has the first focal point at the point B, which is the center of the light source at the forward shift position, and the second focal point at the rear side focal point F of the projection lens 28, and such that the horizontal sectional shape thereof is set to have a curve which is obtained by slightly deforming the ellipse of the vertical sectional shape. According to such a configuration, the auxiliary distribution light pattern formed by the light reflected from the auxiliary reflecting surface 24*a*1 can be formed in a shape such that the auxiliary distribution light pattern PMa shown in FIG. 7B is slightly extended in the left and right directions, whereby the hot zone HZM can be formed in a wide shape.

While there has been described in connection with the exemplary embodiments of the present invention, it will be obvious to those skilled in the art that various changes and modification may be made therein without departing from the present invention. It is intended, therefore, that the appended claims cover all such changes and modifications as fall within the true spirit and scope of the present invention.

What is claimed is:

1. A vehicle headlamp comprising:

a projection lens disposed on an optical axis extending in a longitudinal direction of the vehicle;

a light source disposed on a rear side of a rear side focal point of the projection lens;

a reflector which reflects a light emitted from the light source to a forward direction and toward the optical axis; and a shade disposed such that an upper end edge thereof extends near the rear side focal point of the projection lens, wherein the shade shields a part of the light reflected from the reflector, the light source is movable between a reference position located on the optical axis and a forward shift position located on a forward side of the reference position, and the reflector has an auxiliary reflecting surface located on a lower side of the optical axis, wherein the an auxiliary reflecting surface has a vertical section of an elliptical shape having a first focal point set at a point near the forward shift position and a second focal point set near the rear side focal point of the projection lens;

wherein the reflector includes a primary reflecting surface, a sectional shape of the primary reflecting surface including a first focal point set at the reference position, the sectional shape including the optical axis, wherein the sectional shape of the primary reflecting surface has a second focal point set at a point forward of the rear side focal point of the projection lens.

2. The vehicle headlamp according to claim 1, wherein the sectional shape is a vertical section of the primary reflecting surface.

3. The vehicle headlamp according to claim 1, wherein the auxiliary reflecting surface is formed by a spheroid.

4. The vehicle headlamp according to claim 1, wherein the forward shift position is located on a lower side of the reference position.

5. The vehicle headlamp according to claim 3, wherein the forward shift position is located on a lower side of the reference position.

6. The vehicle headlamp according to claim 1, wherein an entire amount of light reflected from the auxiliary reflecting surface is incident on the shade when the light source is located at the reference position.

7. The vehicle headlamp according to claim 3, wherein an entire amount of light reflected from the auxiliary reflecting surface is incident on the shade when the light source is located at the reference position.

8. The vehicle headlamp according to claim 4, wherein an entire amount of light reflected from the auxiliary reflecting surface is incident on the shade when the light source is located at the reference position.

9. The vehicle headlamp according to claim 5, wherein an entire amount of light reflected from the auxiliary reflecting surface is incident on the shade when the light source is located at the reference position.

10. The vehicle headlamp according to claim 1, wherein the shade can be rotated downward to a shielding release position.

11. A vehicle headlamp comprising:

a projection lens disposed on an optical axis extending in a longitudinal direction of the vehicle;

a light source disposed on a rear side of a rear side focal point of the projection lens;

a reflector which reflects a light emitted from the light source to a forward direction and toward the optical axis; and a shade disposed such that an upper end edge thereof extends near the rear side focal point of the projection lens, wherein the shade shields a part of the light reflected from the reflector, the light source is movable between a reference position located on the optical axis and a forward shift position located on a forward side of the reference position, and the reflector has an auxiliary reflecting surface located on a lower side of the optical axis, wherein the an auxiliary reflecting surface has a vertical section of an elliptical shape having a first focal point set at a point near the forward shift position and a second focal point set near the rear side focal point of the projection lens, wherein the reflector includes a primary reflecting surface, a sectional shape of the primary reflecting surface having a second focal point set at a position farther from the rear side focal point of the projection lens than the second focal point of the auxiliary reflecting surface, the sectional shape including the optical axis.

12. The vehicle headlamp according to claim 11, wherein the sectional shape is a vertical section of the primary reflecting surface.

* * * * *